US006647638B1

(12) United States Patent
Doyal

(10) Patent No.: US 6,647,638 B1
(45) Date of Patent: Nov. 18, 2003

(54) DECK SPACER

(76) Inventor: Eric Doyal, 11539 Emerald Falls Dr., Austin, TX (US) 78738

( * ) Notice: Subject to any disclaimer, the term of this patent is extended or adjusted under 35 U.S.C. 154(b) by 0 days.

(21) Appl. No.: 10/068,741

(22) Filed: Feb. 5, 2002

(51) Int. Cl.[7] ..... E04C 5/16; E04H 12/00; G01D 21/00

(52) U.S. Cl. ..... 33/613; 33/645; 52/677; 52/650.3

(58) Field of Search ..... 52/483.1, 677, 52/716.1, 177, 650.3, 664; 33/613, 645, 526, 527

(56) References Cited

U.S. PATENT DOCUMENTS 1,645,622 A * 10/1927 Prince
4,620,403 A * 11/1986 Field
4,858,399 A * 8/1989 Salato
4,955,142 A * 9/1990 Rieck
4,965,980 A * 10/1990 Leavens
5,148,644 A * 9/1992 Weir
5,280,692 A * 1/1994 Patey
5,560,117 A * 10/1996 Tallman ..... 33/526
5,953,878 A * 9/1999 Johnson
5,997,209 A * 12/1999 Sachs
6,108,992 A * 8/2000 Shaw
2002/0144421 A1 * 10/2002 Hanson ..... 33/613

FOREIGN PATENT DOCUMENTS

GB 676816 * 8/1952

* cited by examiner

*Primary Examiner*—Carl D. Friedman
*Assistant Examiner*—Kevin McDermott
(74) *Attorney, Agent, or Firm*—Johnson & Associates

(57) ABSTRACT

A method and apparatus provides a technique for uniformly spacing deck boards on a deck, as well as protecting the joists of the deck. The invention provides a deck spacer that can be placed over a joist between adjacent deck boards to provide uniform spacing, as well as to cover and protect the portion of the joists which would otherwise be left exposed by the gap between adjacent deck boards.

26 Claims, 2 Drawing Sheets

DECK SPACER

FIELD OF THE INVENTION

This invention relates to decks formed by joists and deck boards. In particular, this invention is drawn to a device for spacing deck boards and protecting joists.

BACKGROUND OF THE INVENTION

A typical prior art deck is constructed by securing deck boards to a plurality of joists. It is usually desirable to space the deck boards apart from each other to allow the deck boards to expand and contract, especially when using wooden deck boards. One problem with prior art decks is that it is difficult to uniformly space the deck boards.

One prior art technique for spacing deck boards is simply to measure the gaps formed between deck boards as they are installed. This technique is labor-intensive and slows down the construction of a deck. Another prior art technique of spacing deck boards is to drive a nail into a joist next to an installed deck board and placing the next deck board against the nails. This technique is also labor-intensive and requires the additional step of pulling the nails out. In other areas of construction, spacers exist for spacing objects. For example, when installing ceramic tile, spacers are available that help the installer to uniformly space the tiles.

Another problem with prior art decks is that the portions of the joists are left exposed by gaps formed between adjacent deck boards. The exposed portions of the joists can then collect water and debris, which can lead to premature decay of the joists.

There is therefore a need for techniques for uniformly spacing deck boards, as well as for protecting joists from decay.

SUMMARY OF THE INVENTION

An apparatus of the invention is provided for a spacer for controlling the spacing between deck boards installed over a plurality of joists comprising: a top surface; first and second sides, wherein the first and second sides are adapted to be positioned next to adjacent deck boards; first and second legs extending downward from the top surface, wherein the first and second legs are spaced apart from each other such that the spacer can be placed over a joist with the first and second legs positioned on opposite sides of the joist.

Another embodiment of the invention provides a method of spacing deck boards installed over floor joists comprising the steps of: installing a first deck board over a plurality of joists; providing a plurality of spacers having first and second sides and a top surface; installing a first spacer over a first floor joist with the first side of the first spacer positioned next to the first deck board; installing a second spacer over a second floor joist with the first side of the first spacer positioned next to the first deck board; and installing a second deck board over the plurality of floor joists such that the second deck board is positioned next to the second sides of the first and second spacers.

Another embodiment of the invention provides a method of protecting joists from water or debris on a deck having a plurality of deck boards installed over a plurality of joists, the method comprising the steps of: providing a plurality of spacers, each spacer having a top surface and first and second legs extending downward from the top surface; and placing the spacers over the joists between adjacent deck boards by positioning the first and second legs of each spacer on opposite sides of the joist on which it is placed with the top surfaces of the spacers facing upward to protect the joists from water or debris.

Other objects, features, and advantages of the present invention will be apparent from the accompanying drawings and from the detailed description that follows below.

BRIEF DESCRIPTION OF THE DRAWINGS

The present invention is illustrated by way of example and not limitation in the figures of the accompanying drawings, in which like references indicate similar elements and in which.

DETAILED DESCRIPTION

Figure 1:
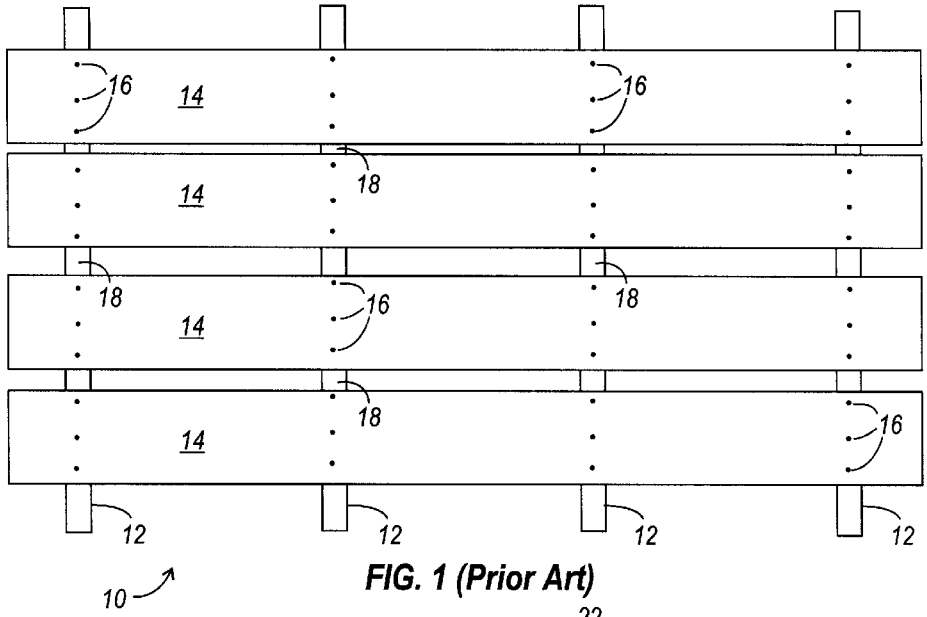
FIG. 1 (Prior Art)
FIG. 1 is a top view of a portion of deck constructed using prior art techniques.

FIG. 1 is a top view of a portion of deck constructed using prior art techniques. FIG. 1 shows a portion of a deck 10 formed by a plurality of floor joists 12. The joists 12 are comprised of lengths of boards (2×6", 2×8", or 2×10", etc., depending on factors such as strength requirements, spans, material strengths, etc.) spaced apart 16 or 24 inches. FIG. 1 shows four deck boards 14 secured to the joists 12 by fasteners 16 (e.g., nails or screws, etc.). The deck boards 14 may be made from numerous types of materials, including boards made of wood or plastic. The dimensions of deck boards vary, with the most common being 2×6" or 5/4 ×6". As mentioned above, one problem with prior art deck construction is that the gaps formed between adjacent deck boards 14 are difficult to make uniform. The deck 10 shown in FIG. 1 provides an example of a deck 10 where the deck boards 14 are not uniformly spaced, resulting in different sized gaps between adjacent deck boards. FIG. 1 also shows the exposed portions 18 of the joists 12 at each gap. Since the portions 18 of the joists 12 are left exposed, water and debris may cause the joists 12 to prematurely decay.

In general, the present invention provides a technique for uniformly spacing the deck boards, as well as protecting the joists. The invention provides a deck spacer that can be placed over a joist between adjacent deck boards to provide uniform spacing, as well as to cover and protect the portion of the joists which would otherwise be left exposed by the gap between adjacent deck boards.

Figure 2:
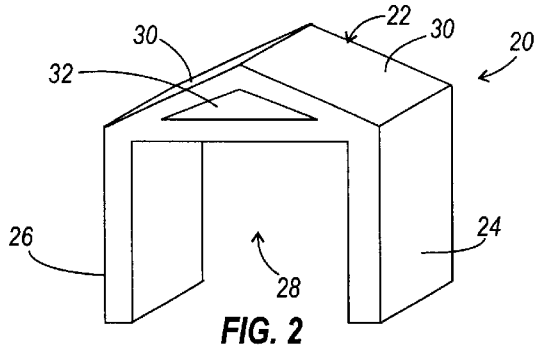
FIG. 2 is an isometric view of a deck spacer of the present invention.

FIG. 2 is an isometric view of a deck spacer 20 of the present invention. The deck spacer 20 is used to uniformly space deck boards and to protect the joists. The spacer 20 is comprised of a top surface 22 and first and second legs 24 and 26, which together form a channel 28. The channel 28 formed between the first and second legs 24 and 26 is sized so that can be placed over a joist with the first and second legs 24 and 26 positioned on opposite sides of the joist. The top surface 22 is formed by first and second portions 30 that slope downward and form a peak near the middle of the spacer 20. Note that other variations of the top surface 22 are described below. The spacer 20 shown in FIG. 2 also includes a triangular shaped opening 32 which is not essential to the invention, but simplifies the manufacturing of the spacer 20, if the spacer is injection molded.

Figure 3:
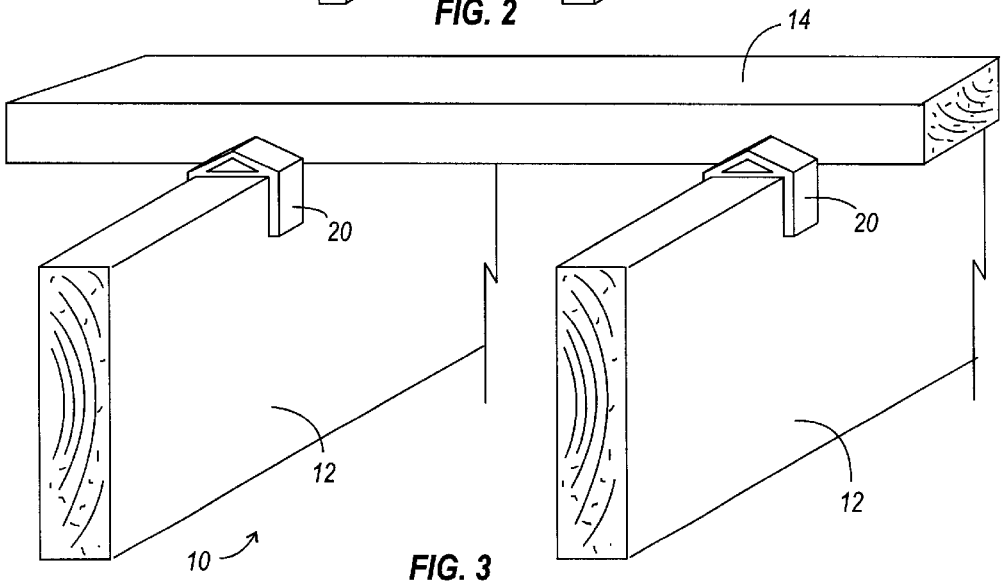
FIG. 3 is an isometric partial view of a deck with two deck spacers installed on the deck.

FIG. 3 is an isometric partial view of a deck 10 with two deck spacers 20 installed on the deck 10. FIG. 3 shows two joists 12 with one deck board 14 secured to the joists 12. Two spacers 20 are placed over the joists 12 with a first side of the spacers 20 placed against the deck board 14 and a second side of the spacers 20 facing outward where the next deck board will be placed. During construction, after each deck board 14 is installed, a spacer 20 can be installed on all or some of the joists 12 as is shown in FIG. 3. The next deck board can be placed over the joists 12 next to the spacers 20. In this way, the deck boards 14 will be uniformly spaced.

Figure 4:
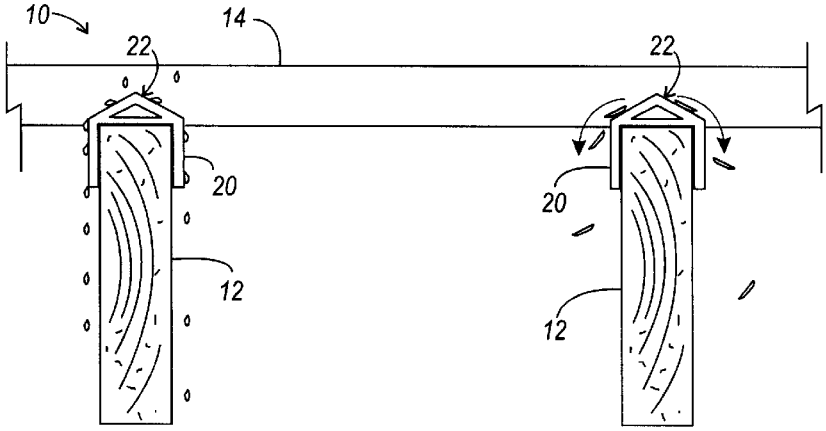
FIG. 4 is a sectional side view of a deck and spacers to illustrate how the spacers protect the joists from water or debris.

FIG. 4 is a sectional side view of a deck 10 and spacers 20 to illustrate how the spacers protect the joists 12 from water or debris. In FIG. 4, the spacer 20 on the left is shown with a plurality of water droplets falling onto the spacer 20. As shown, the water droplets that land on the top surface 22 of the spacer 20 flow down off the top surface 22 and are prevented from coming into contact with the joist 12. As result, less water will sit on top of the joists 12 in the gaps formed between adjacent deck boards 14. Similarly, the spacer 20 on the right side in FIG. 4 is shown with debris falling onto the spacer 20. Like the water, the debris is deflected away from the joist 12 by the top surface 22 of the spacer 20. As a result, debris will not build up on top of the joists 12 in the gaps formed between adjacent deck boards 14.

Figure 5:
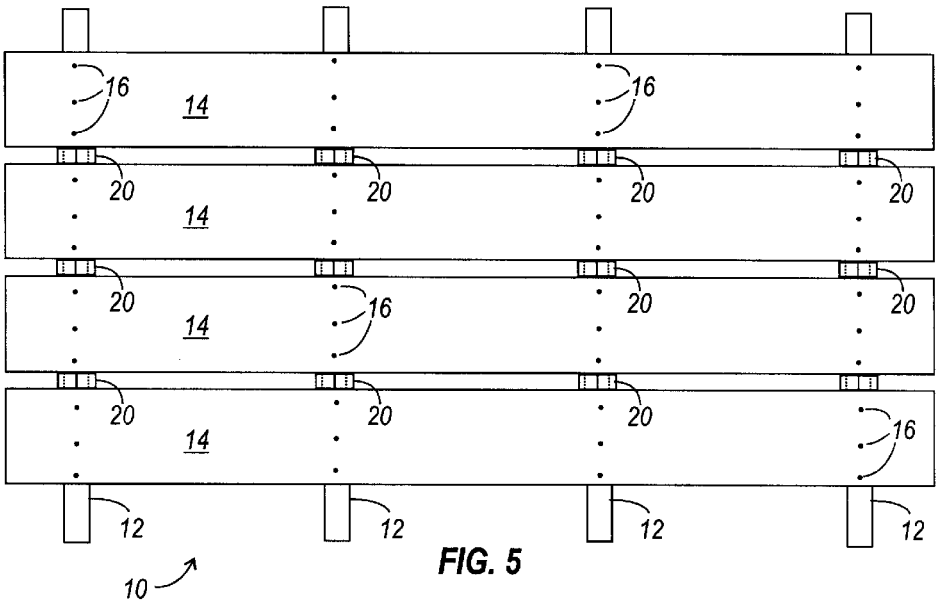
FIG. 5 is a top view of a deck similar to that shown in FIG. 1, using techniques of the present invention.

FIG. 5 is a top view of a deck similar to that shown in FIG. 1, using techniques of the present invention. As shown, a spacer 20 is placed between adjacent deck boards 14 at each joist 12. As a result, the deck boards 14 in FIG. 5 are uniformly spaced, resulting in a more aesthetically pleasing deck. In addition, the joists 12 are not exposed at the gaps between adjacent deck boards like they are on the prior art deck shown in FIG. 1. If desired, spacers 20 can be placed between deck boards, but not on every joist 12. For example, if an installer wants uniformly spaced deck boards 14, but is not concerned about protecting the joists 12, then fewer spacers can be used (e.g., installing a spacer near each end of a deck board). In addition, if the installer is not concerned about protecting the joists 12, then the spacers 20 can be removed after the deck boards 14 are installed. Another benefit of the present invention is that the spacers can save on material costs in the case where an installer (without the benefit of the spacer of the present invention) makes the gaps smaller than desired. With smaller gaps, more deck boards may be required.

Figure 6:
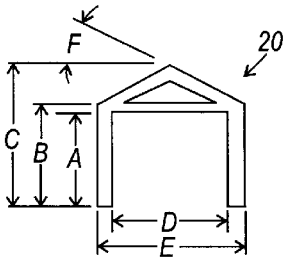
FIG. 6 is a side view of a deck spacer used to illustrate one example of suitable dimensions for a spacer.

FIG. 6 is a side view of a deck spacer 20 used to illustrate one example of suitable dimensions for a spacer. The various dimensions labeled in FIG. 6 are illustrated in table 1 below. Note that these dimensions provide just one example of suitable dimensions and that various other shapes and dimensions can be used. The gap formed between adjacent deck boards 14 is controlled by the width of the spacers 20. For example, if a 0.25 inch gap is desired, 0.25 inch wide spacers should be used. Similarly, if a 0.5 inch gap is desired, 0.5 inch wide spacers should be used.

TABLE 1

| Item | Dimension |
|---|---|
| A | 1.13 inches |
| B | 1.25 inches |
| C | 1.75 inches |
| D | 1.50 inches |
| E | 1.75 inches |
| F | 30 degrees |

Figure 7:
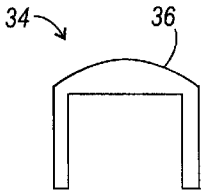
FIGS. 7 and 8 illustrate two other examples of deck spacers.
Figure 8:
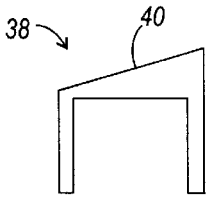

FIGS. 7 and 8 illustrate two other examples of deck spacers. In FIG. 7, a deck spacer 34 is shown having a curved top surface 36. In FIG. 8, a deck spacer 38 is shown having a sloped top surface 40 with a peak at one side, rather than in the middle. In addition, the top surface of a spacer can take on numerous shapes, including being flat with no slope. In other examples, the legs of a spacer can take on numerous shapes and configurations. Although the spacers described above are intended to be placed over a joist and held in place by gravity and friction, the spacers can be fastened to the joist or deck boards if desired. The deck spacers may be comprised of any suitable material, including plastic, metal, wood, ceramics, etc.

In the preceding detailed description, the invention is described with reference to specific exemplary embodiments thereof. Various modifications and changes may be made thereto without departing from the broader spirit and scope of the invention as set forth in the claims. The specification and drawings are, accordingly, to be regarded in an illustrative rather than a restrictive sense.

What is claimed is:

1. A method of spacing deck boards installed over floor joists comprising the steps of:

installing a first deck board over a plurality of joists;

providing a plurality of spacers having first and second sides and a top surface;

installing a first spacer over a first floor joist with the first side of the first spacer positioned next to the first deck board without extending into the first deck board, wherein the top surface of the first spacer does not extend above the first deck board;

installing a second spacer over a second floor joist with the first side of the first spacer positioned next to the first deck board without extending into the first deck board, wherein the top surface of the second spacer does not extend above the first deck board;

installing a second deck board over the plurality of joists such that the second deck board is positioned next to the second sides of the first and second spacers; and leaving the first and second spacers over the first and second floor joists after all the deck boards are installed.

2. The method of claim 1, further comprising the step of installing a third spacer over a third floor joist with the first side of the third spacer positioned next to the first deck board and the second side of the third spacer positioned next to the second deck board.

3. The method of claim 1, further comprising the step of installing spacers on each of the plurality of joists between the first and second deck boards.

4. The method of claim 1, further comprising the step of installing a plurality of deck boards over the floor joists with a plurality of spacers installed over the floor joists between each of the deck boards.

5. The method of claim 1, wherein the top surfaces of each of the spacers is sloped downward to deflect water or debris away from the floor joists.

6. The method of claim 1, wherein each of the spacers has first and second legs extending downward from the top surface, and wherein each spacer is installed by sliding the spacer over a joist with the first and second legs positioned on opposite sides of the joist.

7. The method of claim 1, wherein the top surface of each spacer is sloped downward to encourage water and debris to slide off the spacers and away from the joists.

8. The method of claim 7, wherein the top surface of each spacer has a peak located near the center of the spacer and first and second top sides, wherein each top side slopes downward from the peak.

9. The method of claim 8, wherein the first and second top sides are flat.

10. The method of claim 8, wherein the first and second top sides are curved.

11. The method of claim 1, wherein the spacers do not function to secure the deck boards to the floor joists.

12. A method of spacing deck boards installed over floor joists comprising the steps of:

installing a first deck board over a plurality of joists;

providing a plurality of spacers having first and second sides and a top surface;

installing a first spacer over a first floor joist with the first side of the first spacer positioned next to the first deck board, wherein the top surface of the first spacer does not extend above the first deck board;

installing a second spacer over a second floor joist with the first side of the first spacer positioned next to the first deck board;

installing a second deck board over the plurality of floor joists such that the second deck board is positioned next to the second sides of the first and second spacers; wherein the top surfaces of each of the spacers is sloped downward to deflect water or debris away from the floor joists; and leaving the first and second spacers over the first and second floor joists after all the deck boards are installed.

13. The method of claim 12, wherein the top surfaces of each of the spacers is curved.

14. The method of claim 12, wherein each of the spacers has first and second legs extending downward from the top surface, and wherein each spacer is installed by sliding the spacer over a joist with the first and second legs positioned on opposite sides of the joist.

15. The method of claim 12, wherein the spacers do not function to secure the deck boards to the floor joists.

16. The method of claim 12, wherein the top surface of each spacer is sloped downward to encourage water and debris to slide off the spacers and away from the joists.

17. The method of claim 16, wherein the top surface of each spacer has a peak located near the center of the spacer and first and second top sides, wherein each top side slopes downward from the peak.

18. The method of claim 17, wherein the first and second top sides are flat.

19. The method of claim 17, wherein the first and second top sides are curved.

20. A method of spacing deck boards installed over floor joists comprising the steps of:

installing a first deck board over a plurality of joists;

providing a plurality of spacers having first and second sides and a top surface;

installing a first spacer over a first floor joist with the first side of the first spacer positioned next to the first deck board, wherein the top surface of the first spacer does not extend above the first deck board;

installing a second spacer over a second floor joist with the first side of the first spacer positioned next to the first deck board, wherein each of the spacers has first and second legs extending downward from the top surface, and wherein each spacer is installed by sliding the spacer over a joist with the first and second legs positioned on opposite sides of the joist;

installing a second deck board over the plurality of floor joists such that the second deck board is positioned next to the second sides of the first and second spacers; and leaving the first and second spacers over the first and second floor joists after all the deck boards are installed.

21. The method of claim 20, wherein the top surfaces of each of the spacers is sloped downward to deflect water or debris away from the floor joists.

22. The method of claim 20, wherein the spacers do not function to secure the deck boards to the floor joists.

23. The method of claim 20, wherein the top surface of each spacer is sloped downward to encourage water and debris to slide off the spacers and away from the joists.

24. The method of claim 23, wherein the top surface of each spacer has a peak located near the center of the spacer and first and second top sides, wherein each top side slopes downward from the peak.

25. The method of claim 24, wherein the first and second top sides are flat.

26. The method of claim 24, wherein the first and second top sides are curved.

* * * * *